US007856861B2

(12) United States Patent
Van Essen

(10) Patent No.: US 7,856,861 B2
(45) Date of Patent: Dec. 28, 2010

(54) SWAGE PRESSES

(76) Inventor: Fred Van Essen, Unit 1/8 Techno Park Drive, Williamstown, Victoria 3016 (AU)

( * ) Notice: Subject to any disclaimer, the term of this patent is extended or adjusted under 35 U.S.C. 154(b) by 138 days.

(21) Appl. No.: 10/597,995

(22) PCT Filed: Feb. 16, 2005

(86) PCT No.: PCT/AU2005/000194

§ 371 (c)(1),
(2), (4) Date: Jul. 2, 2007

(87) PCT Pub. No.: WO2005/077566

PCT Pub. Date: Aug. 25, 2005

(65) Prior Publication Data

US 2007/0271989 A1 Nov. 29, 2007

(30) Foreign Application Priority Data

Feb. 16, 2004 (AU) ..... 2004900774

(51) Int. Cl.
*B21D 41/00* (2006.01)
*B21J 9/18* (2006.01)

(52) U.S. Cl. ..... 72/402; 72/453.02

(58) Field of Classification Search ..... 72/402, 72/76, 453.01, 453.02, 453.15
See application file for complete search history.

(56) References Cited

U.S. PATENT DOCUMENTS

| | | | | |
|---|---|---|---|---|
| 4,014,202 | A * | 3/1977 | Van Allen et al. | 72/402 |
| 4,107,964 | A * | 8/1978 | Smith | 72/402 |
| 4,306,442 | A * | 12/1981 | Schrock | 72/402 |
| 4,873,755 | A * | 10/1989 | Johnston | 29/237 |
| 5,440,971 | A * | 8/1995 | Yuda | 92/165 PR |
| 6,510,722 | B1 * | 1/2003 | Ching et al. | 72/402 |

FOREIGN PATENT DOCUMENTS

| | | |
|---|---|---|
| EP | 1 162 012 | 12/2001 |
| WO | WO 01/21337 | 3/2001 |

OTHER PUBLICATIONS

The International Search Report for PCT Application No. PCT/AU2005/000194; Filed Feb. 16, 2005; Date of Completion Feb. 28, 2005; Date of Mailing Mar. 7, 2005.

* cited by examiner

*Primary Examiner*—Dana Ross
*Assistant Examiner*—Mohammad Yusuf
(74) *Attorney, Agent, or Firm*—Alston & Bird LLP

(57) ABSTRACT

A swage or crimp press has a housing with a peripheral side wall and a front wall integrally formed with the side wall, the front wall defining an access opening providing access to a press zone arranged within the peripheral side wall, the housing having an open rear face and a rear wall secured by fastening means to the peripheral side wall to at least partially enclose the rear face of the housing, and a hydraulically operated press mechanism located within the housing at least partially surrounding the press zone.

7 Claims, 2 Drawing Sheets

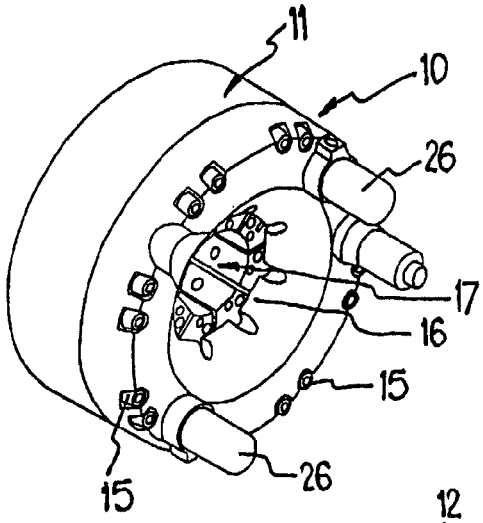
fig 1
PRIOR ART
fig 2
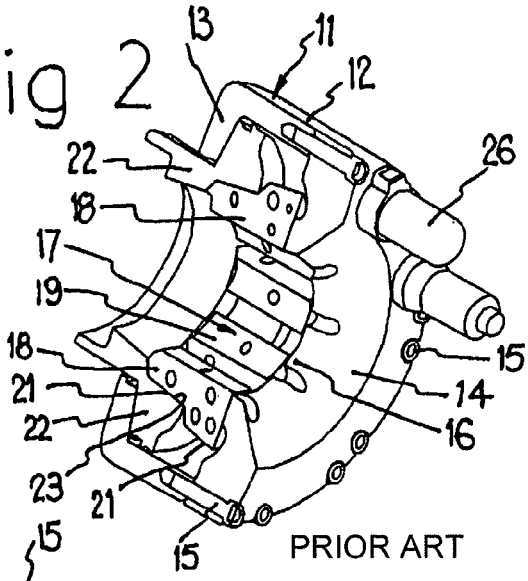
PRIOR ART
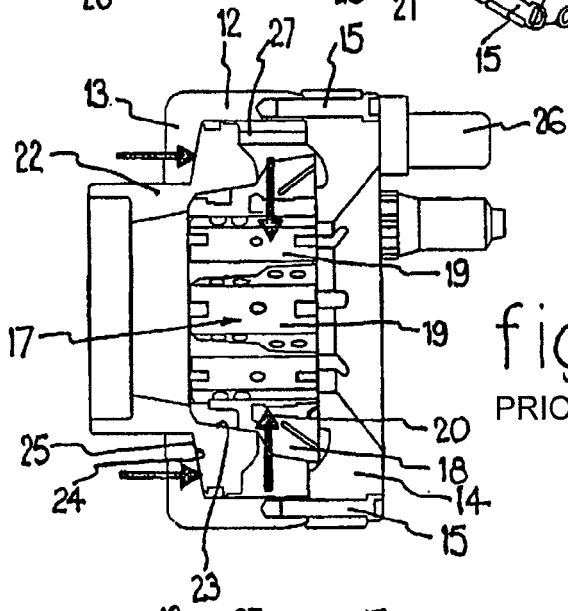
fig 3
PRIOR ART
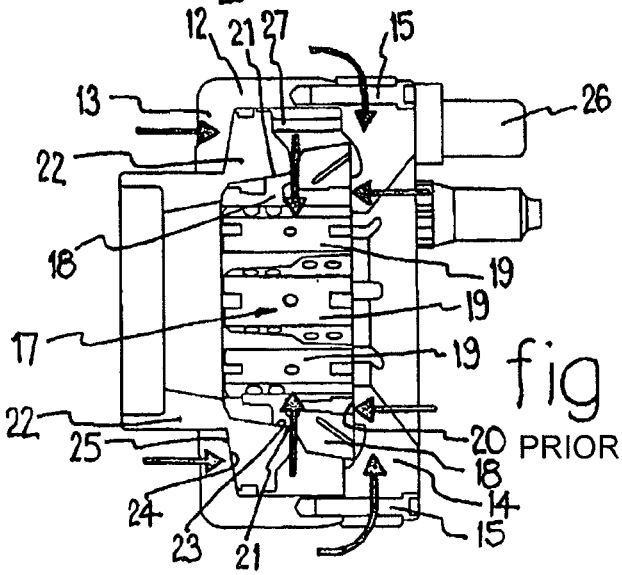
fig 4
PRIOR ART

SWAGE PRESSES

The present invention relates to an improvement in machinery used in the assembly of metal couplings to flexible hoses and comparable applications. Such machines are commonly called "crimp presses" in some fields and in others, they are called "swage presses". In this specification such machines are referred to as "swage presses" but it is to be understood that such terminology includes "crimp presses" and any comparable machinery.

BACKGROUND ART

In recent years the connection of metal couplings has been achieved by reducing the diameter of a metal sleeve (ferrule) over the end of a hose which has been pushed onto a coupling tail. This is achieved with the metal in a "cold state" which has meant, along with the ability to maintain continuity in the case of hydraulic transmission hoses at extreme pressures, that high radial loads are required, to effect the required deformation of the metal sleeve (ferrule).

Also, as the ferrule, hose and tail assembly are produced with various densities or structures along their axial length and the subsequent compression of the total assembly has meant the final "swage" was not cylindrical but tapered. This has required that the machinery not only be strong but also extremely rigid.

There are various designs of swage presses able to achieve this function. All employ some method of "wedging" one component against another to bring typically eight elements (shoes) radially in from one diametrical arrangement to another. By far the most popular and the most economical to manufacture swage press has been the "cone/shoe" type arrangement. A view of such a swage press machine part is depicted in FIG. 1 of the drawings annexed hereto.

In FIG. 2 and FIG. 3 of the annexed drawings, further sectioned views of the swage press machine part shown in FIG. 1 (usually termed "head assembly"), the various working elements are shown. It can be seen that should hydraulic pressure be applied to the rear of the operating piston that the operating piston will move forward. As the piston has a cone shape in its internal formation, and this cone shaped formation bears onto the shoe elements which are in turn wedged against the front plate or flange, these shoe elements will be driven inwards creating "pallets" of an ever decreasing cylindrical arrangement.

As can be seen in FIG. 4 of the annexed drawings, the housing element is manufactured as a single element. In the assembly of this arrangement, the operating piston is inserted from the front, the shoe cluster is then inserted and finally the front plate or flange is bolted onto the front of the housing. All current machines of this type are produced in this manner.

A weakness in this design is that if say the operating piston produces 100 tonne of force, then the front plate or flange must be able to withstand the same amount of reactive force. The quality of the swaging process and the ultimate performance and rigidity of the machine is due largely to the design and ultimate performance of the front plate or flange. As bolts are commonly used to retain the front plate or flange onto the housing, these bolts must also provide a reactive moment as well as the reactive axial force to resolve the out of alignment force of the shoe elements.

Using too many retaining bolts produces a weakness in the front plate or flange as the flange will flex more if there are more retaining bolt holes. The amount of bolt holes acts as a "perforation" and causes a weakness in an area where the highest moment forces exist. In reality, the minimum amount of bolts are used to achieve a 2:1 safety margin in order to achieve the stiffest possible front plate or flange, the least amount of flex and ultimately the highest performance and quality swage possible.

One further serious flaw with existing designs such as those shown in FIGS. 1 to 4, is that in a number of cases, due to incorrect component selection and/or human error in regard to the torque applied to the bolts, catastrophic failure has occurred providing significant health and safety risks to operators who operate the swage press from the front as is usually the case. Such failures in some cases have included having the bolts breaking and firing at high velocity towards the operator.

DISCLOSURE OF THE INVENTION

The objective of the present invention is to provide improvements in a swage press construction that will provide a greater safety margin in use and a more rigid arrangement that will improve performance of the press.

Accordingly, the present invention provides a head assembly for a swage press including a housing having a peripheral side wall, a front wall integrally formed with said peripheral side wall with an opening in said front wall providing access to a press zone arranged within said peripheral side wall, said housing having an open rear face; a rear wall secured by fastening means to said peripheral side wall to at least partially close said rear face of the housing, and a hydraulically operated press mechanism located within said housing at least partially surrounding said press zone.

In accordance with a further aspect, the present invention also provides a head assembly for a swage press, the head assembly including:

(i) a housing having a peripheral side wall, a front wall integrally formed with said peripheral side wall with an opening providing access to a press zone arranged within said peripheral side wall, said housing having an open rear face;

(ii) a plurality of shoe elements having press surfaces facing radially toward said press zone with said shoe elements being restrained by said front wall to move in a radial direction toward and away from said press zone;

(iii) an operating piston means cooperable with each said shoe element whereby movement of said operating piston means toward said front wall causes radial movement of the press surfaces of said shoe elements inwardly toward said press zone; and (iv) a rear wall secured by fastening means to said peripheral side wall to at least partially close said rear face of the housing, said rear wall cooperating with said operating piston means to define at least one chamber for receiving high pressure hydraulic fluid to effect movement of said operating piston means toward said front wall.

Preferred features of the invention may be as defined in claims 3 to 7 annexed hereto, the subject matter of these claims are hereby incorporated in the disclosure of this specification by this reference thereto.

The present invention achieves the aforementioned objectives by providing an arrangement where the front wall and the peripheral side wall are formed integrally or in one piece thereby providing a far stiffer and stronger front wall. Thus the front wall is less likely to flex under heavy load improving the swaging performance of the press and forward directed catastrophic failure of the assembly is unlikely to occur or the prospect of same is greatly lessened.

A preferred embodiment of the present invention will hereinafter be described with reference to the accompanying drawings, it being recognized that FIGS. 1 to 4 illustrate an example of prior art swage press head assemblies, whereas features of the present invention may be seen from FIGS. 5 and 6.

BRIEF DESCRIPTION OF THE DRAWINGS

FIG. 1 is a perspective view of a swage press head assembly according to a prior art design;

FIG. 2 is a diametrically sectioned perspective view of the swage press head assembly shown in FIG. 1;

FIGS. 3 and 4 are diametrically sectioned side elevation views of the swage press head assembly of FIG. 1;

BEST MODE FOR CARRYING OUT THE INVENTION

Figure 5:
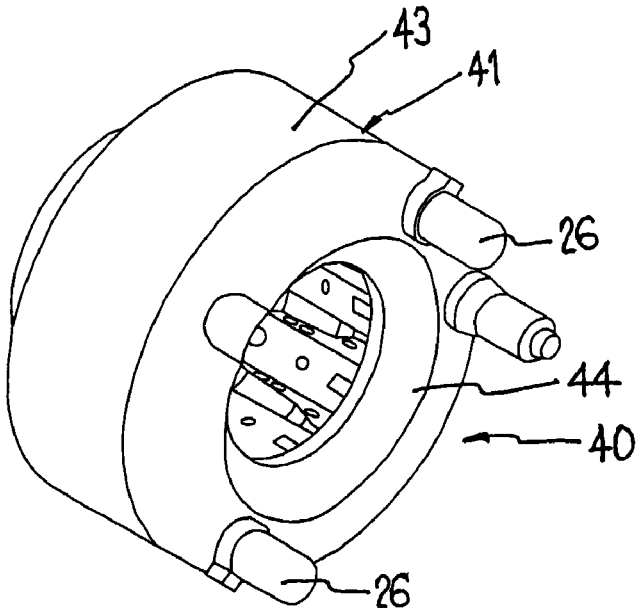
FIG. 5 is a perspective view of a swage press head assembly according to a preferred embodiment of the present invention.

Referring first to FIGS. 1 to 4 of the annexed drawings, a typical example of a head assembly 10 for a swage press according to a prior art design is illustrated. The head assembly 10 includes a cup shaped housing 11 having a generally annular side wall 12 with a rear wall 13 partially closing a rear face of the assembly. The rear wall and side wall 12, 13 are integrally formed. The side wall 12 defines an open forward face which is partially closed by a front wall flange 14 bolted to the side wall by a plurality of fastening bolts 15. The front wall flange 14 defines a central opening 16 enabling access to an internal centrally located press zone 17. Around the press zone 17, a plurality of shoe elements 18 are provided, each having a press face 19 facing inwardly towards the press zone 17 with the shoe elements 18 being arranged in an annular cluster whereby each element is capable of moving inwardly and outwardly in a radial direction. The shoe elements 18 are, however, restrained at a forward end against an inwardly facing surface 20 of the front wall flange 14 so that they cannot move in a forward direction beyond the position illustrated. Each of the shoe elements have a rear or outwardly facing inclined ramp surface 21 which may, as illustrated, comprise a series of inclined ramp surfaces of differing angles. An operating piston member 22 is provided cooperating with the shoe elements 18. The piston member 22 is annularly formed with an inwardly facing truncated cone surface 23 acting as a cam engageable with the inclined ramp surfaces 21 of the shoe elements 18 such that when the piston member 22 moves towards the front wall flange 14, the shoe elements are moved radially inwardly by interengagement of the truncated cone camming surface 23 with the inclined ramp surfaces 21 of the shoe elements 18. Movement of the operating piston member 22 towards the front wall flange 14 is achieved by introducing high pressure hydraulic fluid via a connection not illustrated, into an annular cavity defined in part between an inwardly and forwardly facing annular wall surface 24 of the rear housing wall 13 and a rearwardly facing annular wall surface 25 on the piston member 22. Restoration rod mechanisms 26 including push rods 27 enable the operating piston member 22 to be reset to the illustrated position, i.e. pushed backwardly, after a swaging operation has been completed and ready for the next swaging operation.

Figure 6:
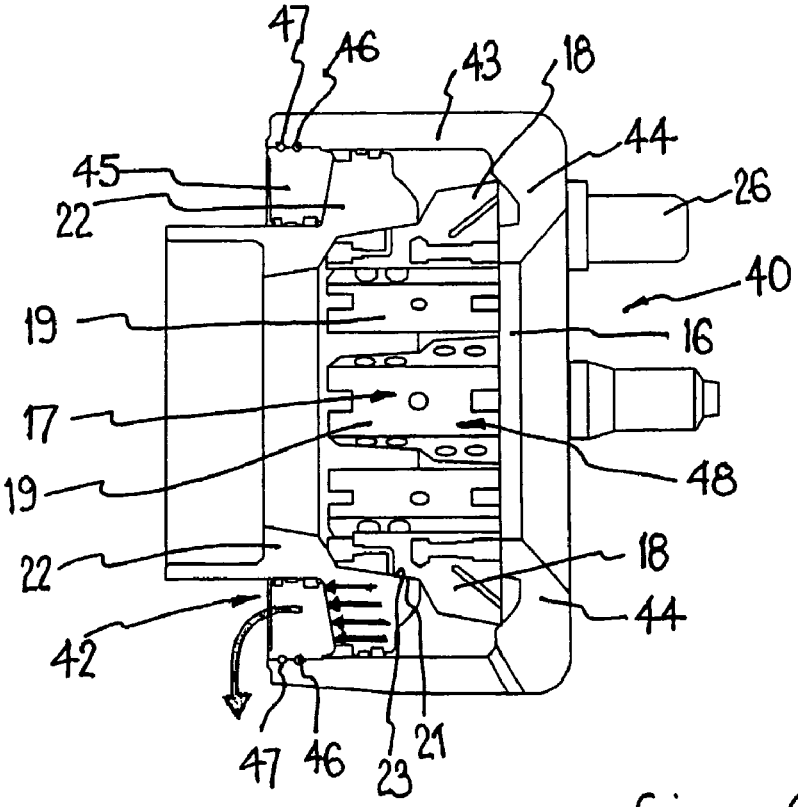
FIG. 6 is a transverse section view in side elevation of the swage press head assembly shown in FIG. 5.

FIGS. 5 and 6 of the annexed drawings illustrate a solution to the above discussed difficulties associated with arrangements such as those shown in FIGS. 1 to 4 in accordance with one preferred embodiment of this invention. In FIGS. 5 and 6, like features as are shown in FIGS. 1 to 4 have been given the same reference numerals and operate in a similar manner. In FIGS. 5 and 6, the head assembly 40 has a housing 41 that is also cap shaped but with an open rear face 42 generally facing in a rearward direction. The housing 41 includes a peripheral side wall 43 which is annular and circular in shape with an integrally formed front wall flange 44. Thus any form of fastener means retaining the front wall flange 44 is not required and a stronger more rigid structure against which the shoe elements 18 work, is achieved.

As can be seen from FIG. 6. the head assembly 40 is now assembled from the rear. A press mechanism 48 of any desired configuration but typically as shown in FIG. 1 including a cluster of shoe elements 18 is assembled and inserted from the rear. The operating piston member 22 of the press mechanism 48 is then inserted and finally an end retaining cap 45 is positioned and fastened as illustrated.

The resultant axial load that was retained by a separate front wall flange which was in turn restrained by separate bolts is now restrained by one component able to withstand more effectively the moment forces created by the non-aligned restraining forces created by the shoes.

The end cap 45 is preferably press fitted into one portion of the housing 40 at or adjacent the rear face 42 and is attached via two wires 46 inserted from either end of the housing after the end cap 40 has been inserted, the wires 46 being pressed into passages 47 formed by grooves in the end cap outer wall surface and the inner wall surface of the side wall 43. In this case, the rotational moment created by the hydraulic pressure which may be 100 tonne is more evenly dispersed around the entire area of the front wall flange 44 instead of the inner lip of the separate front wall as depicted in the prior art arrangement shown in FIGS. 1 to 4.

As the end cap 45 is press fitted into the housing, this portion of the housing acts more effectively in providing a restraining moment force than bolts. The amount of "flex" per unit tonne is much less than with an end cap 45 attached via bolts, however, it should be recognized that in the arrangement shown in FIGS. 5 and 6 fastening bolts could also be used.

The main benefits of the arrangement disclosed in FIGS. 5 and 6 are as follows.

The overall construction is far stiffer with less flex in the restraining front wall flange. The amount of "flex" determines how "stiff" the arrangement is and this in turn determines the quality of the swage (crimp) and the arrangements ability to swage (crimp) parallel even with "irregular" product. The front wall flange can also be made with a thinner section thus providing greater access for components to be swagged (crimped). The arrangement is much safer with higher safety margins and no possibility of bolts breaking away and harming an operator. Although the end cap 45 is now a separate component, there is slightly higher flex than before in this region but this extra deflection has no detrimental effect on machine operation or performance. Moreover, if an ultimate failure does occur due to incorrect servicing or assembly this will occur at the rear, away from the operator.

The claims defining the invention are as follows:

1. A head assembly for a swage press including a housing having a peripheral side wall that extends about a circumference of the housing, a front wall integrally formed with said peripheral side wall with an opening in said front wall providing access to a press zone surrounded by said peripheral side wall, said housing having an open rear face and a rear wall secured by fastening means to said peripheral side wall to at least partially close said rear face of the housing, and a hydraulically operated press mechanism located within said housing surrounding said press zone, said press mechanism including a plurality of shoe elements configured to surround said press zone and an annular piston member moved axially by pressurized hydraulic fluid entering a hydraulic chamber defined by said piston member, said rear wall and said peripheral side wall, said annular piston member moving said shoe elements radially into said press zone when said annular piston member moves axially towards said front wall of the housing.

2. A head assembly for a swage press including:

i) a housing having a peripheral side wall that extends continuously and completely about a circumference of the housing, a front wall integrally formed with said peripheral side wall with an opening providing access to a press zone surrounded by said peripheral side wall, said housing having an open rear face;

ii) a plurality of shoe elements having press surfaces facing radially toward said press zone with said shoe elements being arranged circumferentially about said press zone and being restrained by said front wall to move in a radial direction toward and away from said press zone;

iii) an operating piston means cooperable simultaneously with each of said shoe elements whereby movement of said operating piston means toward said front wall causes movement of said shoe elements in said radial direction inwardly toward said press zone; and iv) a rear wall secured by fastening means to said peripheral side wall to at least partially close said rear face of the housing, said rear wall cooperating with said operating piston means to define at least one chamber for receiving high pressure hydraulic fluid to effect movement of said operating piston means toward said front wall.

3. A head assembly according to claim 2 wherein the operating piston means includes a truncated conical surface facing inwardly and cooperating with outwardly facing inclined surfaces on each of said shoe elements to effect radial movement of said shoe elements upon axial movement of the operating piston means towards said front wall.

4. A head assembly according to claim 2 wherein one said chamber is provided for receiving high pressure hydraulic fluid, said chamber being annularly formed with opposed annular faces of the chamber being formed respectively by a surface in said operating piston means and an inwardly facing surface of said rear wall.

5. A head assembly for a swage press including:

i) a housing having a peripheral side wall and a front wall integrally formed with said peripheral side wall with an opening providing access to a press zone surrounded by said peripheral side wall, said housing having an open rear face;

ii) a plurality of shoe elements having press surfaces facing radially toward said press zone with said shoe elements being arranged circumferentially about said press zone and being restrained by said front wall to move in a radial direction toward and away from said press zone;

iii) an operating piston means cooperable simultaneously with each of said shoe elements whereby movement of said operating piston means toward said front wall causes movement of said shoe elements in said radial direction inwardly toward said press zone; and iv) a rear wall secured by fastening means to said peripheral side wall to at least partially close said rear face of the housing, said rear wall cooperating with said operating piston means to define at least one chamber for receiving high pressure hydraulic fluid to effect movement of said operating piston means toward said front wall, wherein the rear wall has an outwardly facing cylindrical surface engaged, when assembled, with an inwardly facing cylindrical surface on the housing peripheral side wall at or adjacent the open rear face, said outwardly facing cylindrical surface having at least one groove formed therein and cooperating with at least one groove formed in the inwardly facing cylindrical surface to provide at least one passage extending at least partially circumferentially between the rear wall and the peripheral side wall, and said fastening means being formed by at least one wire positioned in the or each said passage.

6. A head assembly according to claim 5 wherein two said passages are provided each extending substantially completely around the circumference of the outwardly facing cylindrical surface of the rear wall, a respective said wire being inserted into each of said passages in opposite directions.

7. A head assembly according to claim 5 wherein an extension of the or each said passage extends tangentially therefrom outwardly through the peripheral side wall to be accessed externally of said side wall.

* * * * *